US006886281B2

(12) United States Patent
Smith

(10) Patent No.: US 6,886,281 B2
(45) Date of Patent: May 3, 2005

(54) DISPLAY DEVICE

(75) Inventor: Glenn Smith, Baton Rouge, LA (US)

(73) Assignee: Robotic Displays Corporation, Baton Rouge, LA (US)

( * ) Notice: Subject to any disclaimer, the term of this patent is extended or adjusted under 35 U.S.C. 154(b) by 167 days.

(21) Appl. No.: 10/125,178

(22) Filed: Apr. 17, 2002

(65) Prior Publication Data

US 2002/0148148 A1 Oct. 17, 2002

Related U.S. Application Data

(63) Continuation-in-part of application No. 09/571,187, filed on May 16, 2000, now Pat. No. 6,389,719.

(51) Int. Cl.[7] ..... G09F 11/02
(52) U.S. Cl. ..... 40/473; 345/110; 348/815.83
(58) Field of Search ..... 40/473, 484, 493, 40/501; 345/110; 348/815.83; 74/55, 56, 57, 567, 569, 89.23, 25

(56) References Cited

U.S. PATENT DOCUMENTS 1,221,925 A * 4/1917 Trott ..... 74/471 R
1,566,479 A 12/1925 Horvath et al.
2,063,451 A 12/1936 Lunoe et al. ..... 240/10.1
2,354,605 A 7/1944 Norman ..... 185/1
2,637,936 A 5/1953 Dale et al. ..... 46/120
3,377,578 A 4/1968 Ito ..... 335/229
4,802,572 A * 2/1989 Shorey et al. ..... 198/791
5,063,377 A 11/1991 Smith ..... 340/764
5,141,399 A 8/1992 Duchesneau et al. ..... 416/157
5,142,925 A 9/1992 Fauvel ..... 74/54
5,535,698 A 7/1996 Trevisan ..... 116/277
6,009,647 A 1/2000 Feingold ..... 40/433
6,122,983 A 9/2000 Hoffman ..... 74/337.5
6,389,719 B1 * 5/2002 Smith ..... 40/473

* cited by examiner

*Primary Examiner*—Cassandra Davis
(74) *Attorney, Agent, or Firm*—Jones, Walker, Waechter, Poitevent, Carrere & Denegre, LLP

(57) ABSTRACT

A display device, comprising a central shaft; at least one support arm, rotatably attached to the central shaft; and a cam member having at least one cam surface, the cam surface positioned so as to be engageable with at least one support arm, the cam member being movable at least axially in relation to central shaft. As the cam member moves axially of the central shaft, a cam surface contacts at least one support arm and moves it circumferentially around the central shaft. The shapes of the cam surfaces provide choreographed movement of the support arms. Visual elements may be attached to the support arms.

30 Claims, 14 Drawing Sheets

DISPLAY DEVICE

STATEMENT OF PRIORITY

This application is a continuation-in-part of U.S. application Ser. No. 09/571,187, now filed May 19, 2000, U.S. Pat. No. 6,389,719.

BACKGROUND OF THE INVENTION

1. Field of the Invention

This invention relates generally to display devices and, more particularly, to displays which move visual elements, such as advertising signs or product displays.

2. Description of the Prior Art

U.S. Pat. No. 5,063,377 (Smith) describes a device for producing complex and interesting movements of visual elements around a central axis, but at an increased cost. Varying advertising needs demand an eye-catching display which is also inexpensive and easy to build. The present invention meets the need for an inexpensive and interesting display device, is capable of a multitude of uses and provides an endless variety of movements limited only by the imagination of the builder. Rather than utilize complex electronic circuitry and programming, the present invention utilizes a unique mechanical approach, maintaining simplicity and cost effectiveness.

SUMMARY OF THE INVENTION

Therefore, it is an object of this invention to provide a display device, which allows a visual element to be moved in a desired pattern of movement, which is not necessarily the constant rotation of the visual element about a central axis.

It is another object of this invention to provide a display device, which includes multiple visual elements with multiple faces, the visual elements being movable about a support in a desired pattern so as to expose the faces in different directions.

It is another object of this invention to provide a display device, which allows the display of independently movable visual elements on multiple levels of a support structure.

It is still a further object of this invention to provide a display device and method which accomplishes all of the above objectives in varying combinations and at low cost.

Accordingly, a low cost display device is provided whereby visual elements can be independently transported and displayed. In general, the invention comprises a central shaft; at least one support arm, rotatably attached to the central shaft; and a cam member having at least one cam surface, the cam surface positioned so as to be engageable with at least one support arm, the cam member being movable at least axially in relation to central shaft. As the cam member moves axially in relation to the central shaft, a cam surface contacts at least one support arm and moves it circumferentially around the central shaft. The shapes of the cam surfaces provide choreographed movement of the support arms. Visual elements may be attached to the support arms.

Preferably, the cam member is a tubular member (and more preferably formed in two semi-tubular sections) having cam slots, through which the support arms extend. The shapes of the slots choreograph the movement of the support arms, and thus the movement of the visual elements attached to the support arms. The cam member is threadably attached to a threaded portion of the central shaft, which may be rotated by a reversible motor or other means. As the central shaft rotates in one direction, the cam member travels axially along the shaft, imparting movement to the support arms. Reversing the rotation of the shaft imparts a reverse movement of the support arms as the cam member travels along the shaft in the opposite direction.

As will be understood, the variety of movement patterns and visual elements is limited only by the imagination of the designer of a particular display device made in accordance with the invention. The number of cam members, the number, spacing and pattern of the cam slots, and the various visual elements which may be moved by the cam interface member is limitless. Thus, the invention herein provides an inexpensive and flexible device for use in a multitude of applications.

DETAILED DESCRIPTION OF PREFERRED EMBODIMENTS OF THE INVENTION

Figure 1:
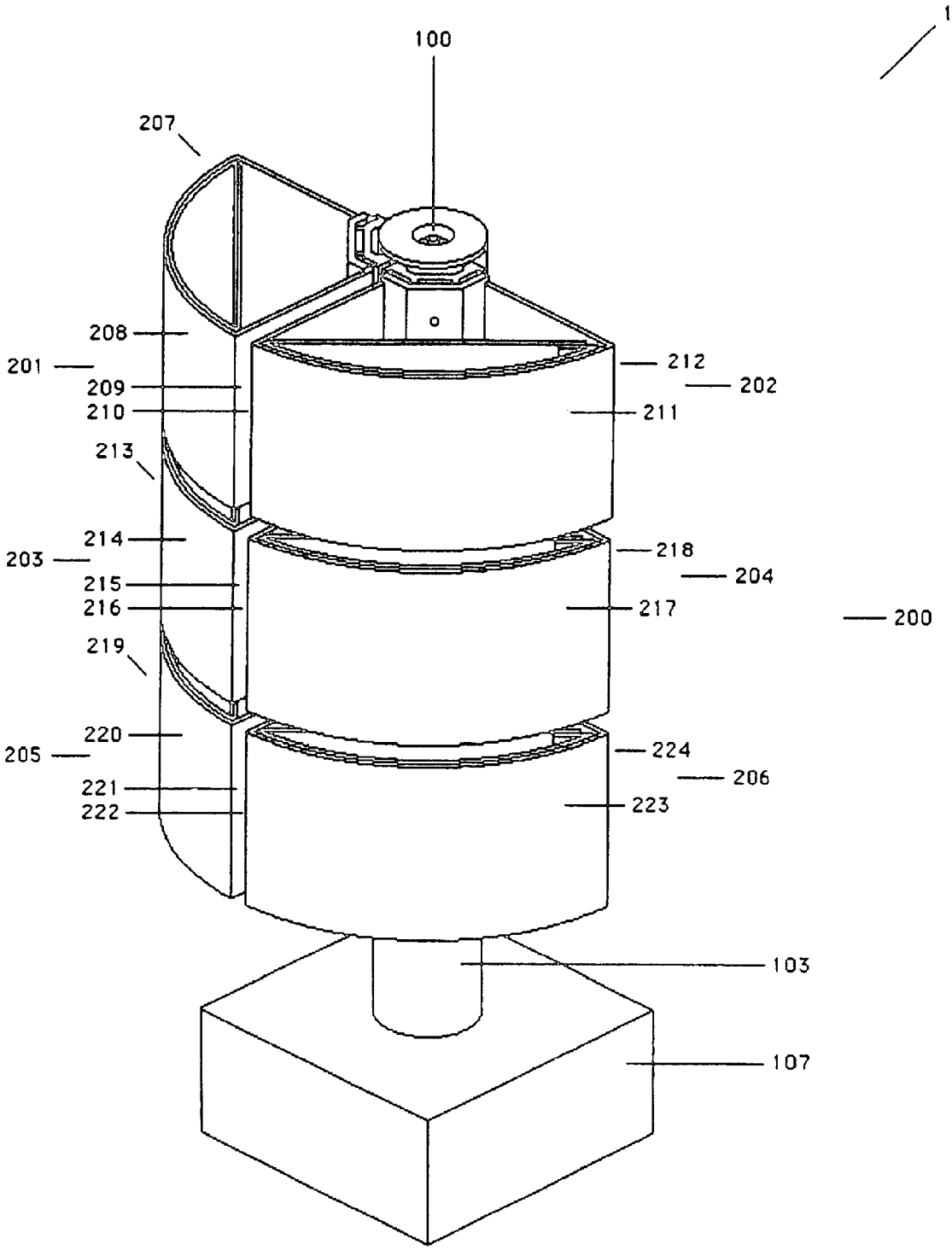
FIG. 1 is a perspective view of an embodiment of the invention illustrating the positioning and movement of visual elements.

As shown in the Figures, the invention generally comprises a display device 1, having a central shaft assembly 100, at least one visual element assembly 200 and a control assembly 300. In the embodiments shown, shaft assembly 100 is shown in a vertical orientation. There is no requirement for vertical orientation. The invention 1 may be oriented horizontally, diagonally or even in a reversed vertical position from that shown. The invention 1 may be floor or table mounted or mounted on walls or ceilings. The size of the display device 1 is dependent only on the desired size of the display and associated economic factors.

Figure 2:
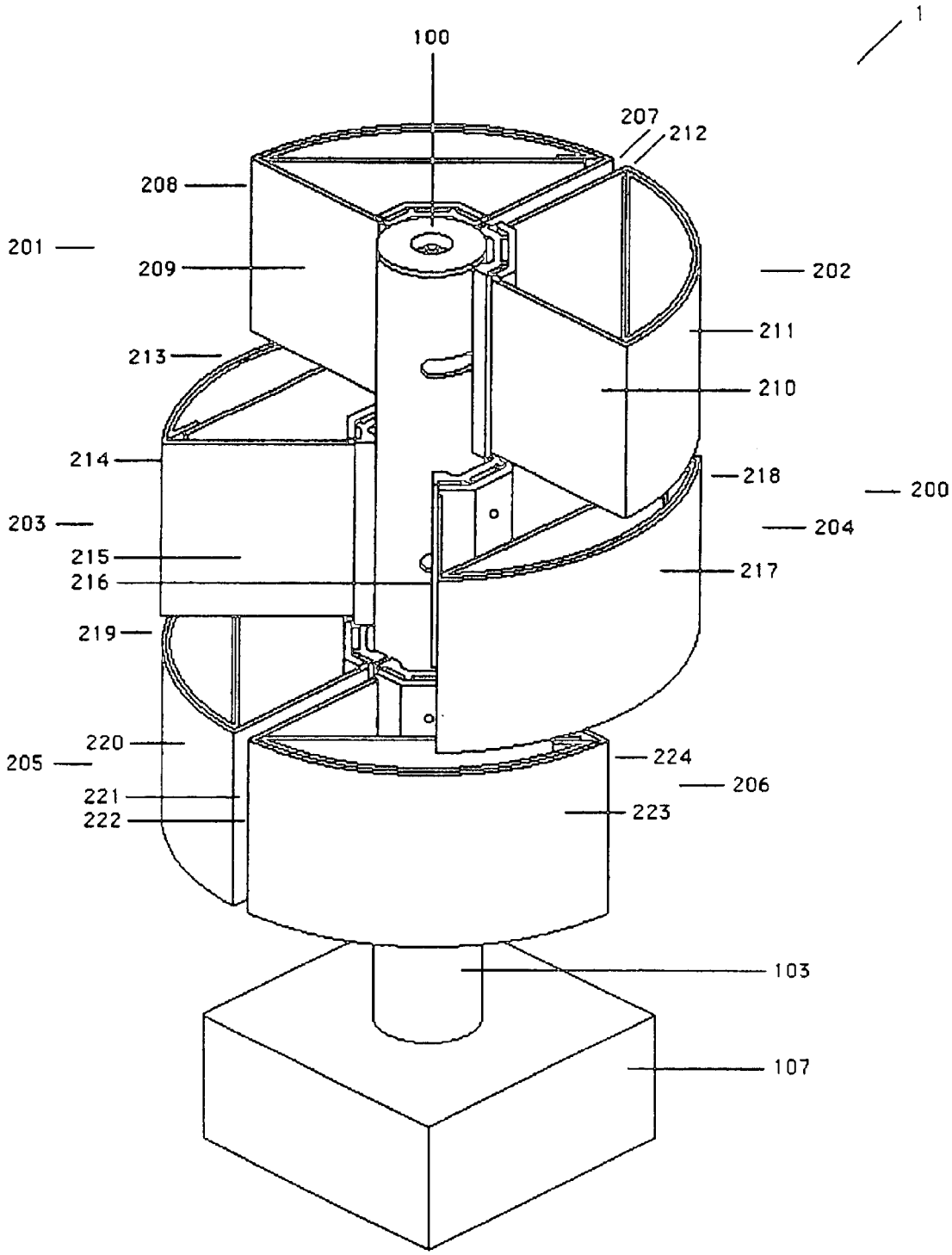
FIG. 2 is a perspective view of an embodiment of the invention illustrating the positioning and movement of visual elements.
Figure 3:
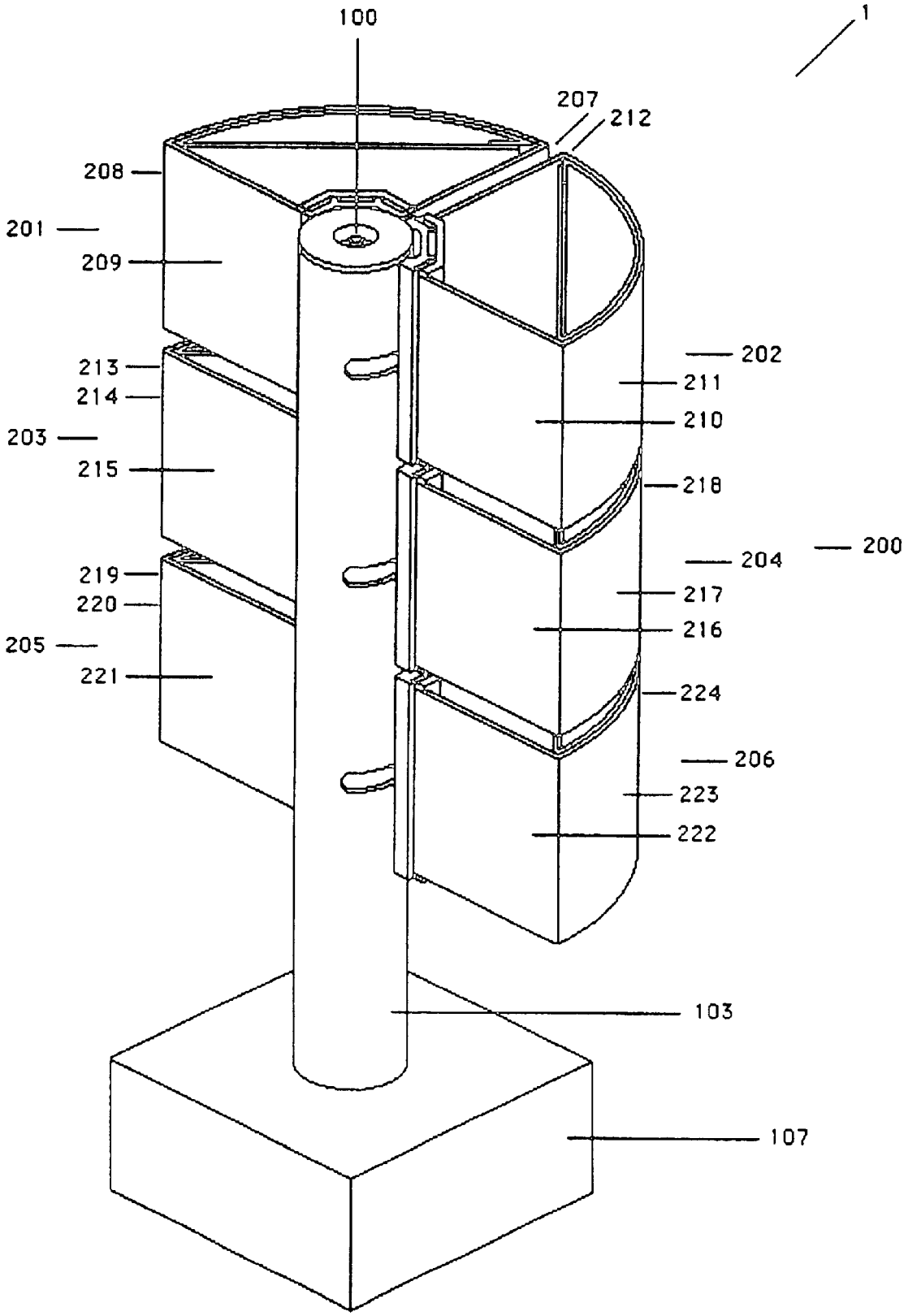
FIG. 3 is a perspective view of an embodiment of the invention illustrating the positioning and movement of visual elements.

Visual element assemblies 200 are depicted in FIGS. 1–4 and FIG. 8. FIGS. 1–3 illustrate a typical sequence of visual element motions which the device 1 can be configured to produce, in this case a sequential top to bottom opening sequence. In the embodiment shown, for example in FIG. 1, the visual element assemblies 200 may combine to form a semi-cylindrical structure, with each individual visual element 201–206 having a quarter-cylindrical structure. However, visual elements 200 can be of virtually any shape or composition. In fact, support arms 108 could form visual elements without the aid of visual element assemblies 200, if desired. The visual elements 200 shown in the Figures are preferably made of folded plastic sheeting, which is lightweight and easily formed into desired shapes. However, any suitable material may be used. Lighting and other elements may be installed in visual elements 200, if desired, but suitable circuitry (not shown) must be added. Also, although in the embodiment shown there are three levels of visual elements 200, the invention 1 may include one or more such levels. Finally, although in the embodiment shown there are two visual elements 200 per level, the invention 1 may include one or more visual elements 200 per level.

In order to understand the possible sequences of movement of visual elements 200, a simple series of movements will be examined. In FIG. 1 the device 1 is shown in an initial static viewing configuration, with all six visual elements 201–206 forming a complete half-cylinder. Correspondingly, all six outer graphics-bearing faces 208, 211, 214, 217, 220 and 223 are oriented toward the viewer. Inner graphics-bearing faces 207, 212, 213, 218, 219 and 224 are oriented away from the viewer, while inner graphics-bearing faces 209, 210, 215, 216, 221, and 222 are hidden from view between the outer graphics-bearing surfaces. Support member 103, shown in the embodiment as a support tube, and base enclosure 107 enclose and support central shaft assembly 100 and control assembly 300 components. Support tube 103 and base enclosure 107 are fixed in position relative to all moving parts of the invention 1. Support tube 103 and enclosure 107 may be constructed of extruded or formed sheet metal, plastic or composite materials by means well known in the art.

In FIG. 2 the device 1 is shown midway through the movement sequence. The top level visual elements 201,202 have been moved ninety degrees in opposite directions around central shaft assembly 100 from their initial positions; the middle level visual elements 203,204 are halfway through a similar movement; and the bottom level visual elements 205,206 have not yet begun to move.

In FIG. 3 the device 1 is shown in a final static viewing configuration, with all six visual elements 201–206 having moved ninety degrees in opposite directions on each level from their original positions. Correspondingly, all six outer graphics-bearing faces 208, 211, 214, 217, 220 and 223 are oriented away from the viewer; inner graphics-bearing faces 209, 210, 215, 216, 221 and 222 are oriented toward the viewer; and inner graphics-bearing faces 207, 212,213,218, 219 and 224 are hidden. Thus, an interesting pattern of movement has been established wherein various faces of visual elements 200 are exposed to the viewer in a timed sequence. If the device continues to operate, control assembly 300 will cause the pattern to reverse itself to return to the position shown in FIG. 1. A more detailed discussion of the components of the invention 1 follows, using FIGS. 4–7 to illustrate the device 1 in the intermediate choreography position of FIG. 2, with various components exploded or removed for clarity.

Figure 4:
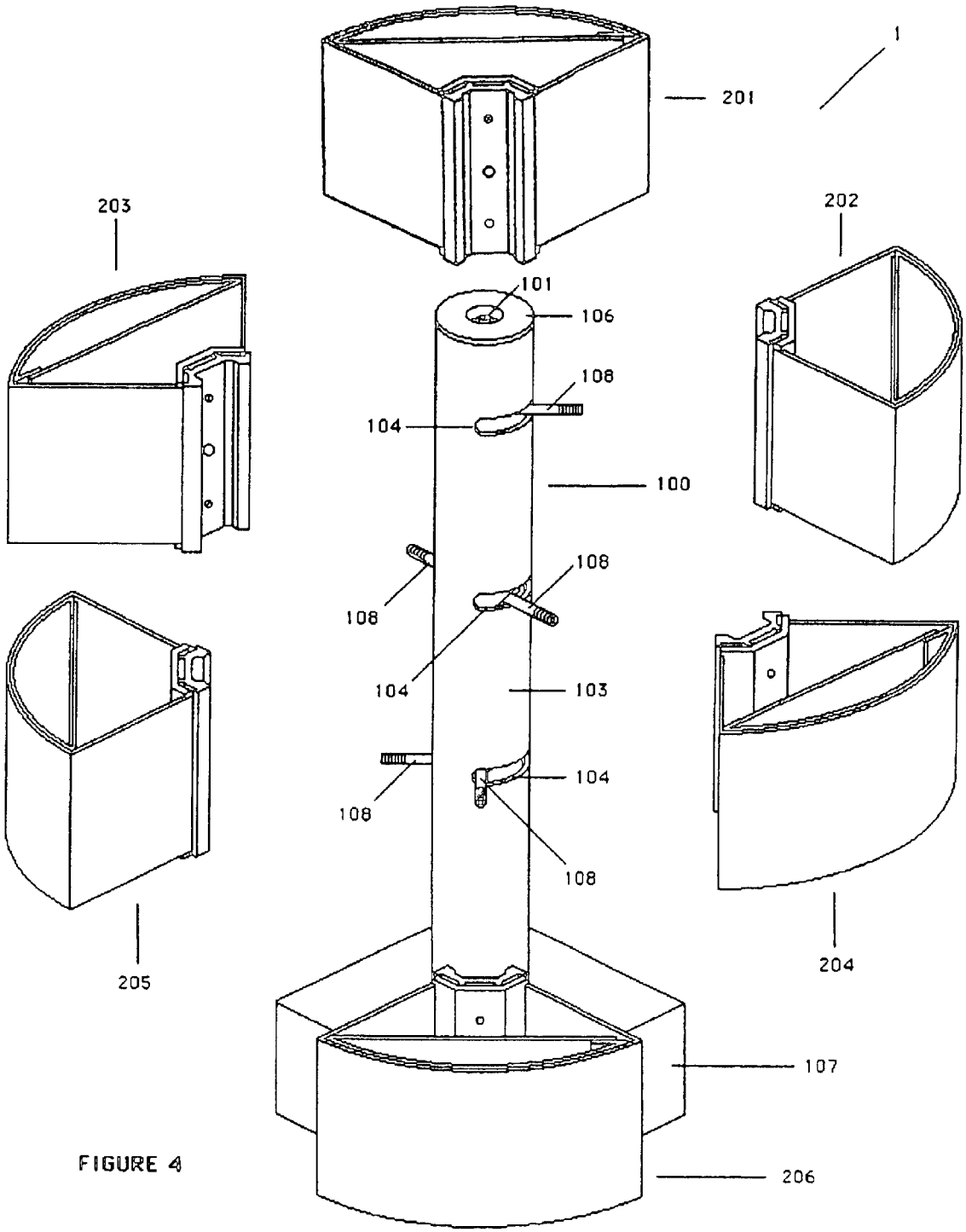
FIG. 4 is an exploded perspective view of a preferred embodiment of the invention showing the visual elements and the central shaft assembly.

FIG. 4 depicts the invention 1 with visual elements 200 exploded to reveal the exterior of shaft assembly 100. Upper end of central shaft 101 is seen protruding slightly from end cap 106, and the six support arms 108 (which support visual elements 201–206) extend through support arm slots 104 in the wall of support tube 103. Support arms 108 may be tubular as shown to provide less weight and a conduit for electrical or communications wiring to connect to visual elements 200. Support arms 108 maybe threaded as shown, to facilitate attachment of visual elements 200 to arms 108. Support tube 103 also serves as a cosmetic cover for the inner components of central shaft assembly 100. In the embodiment shown, support arm slots 104 merely provide space for circumferential movement of arms 108 about central shaft 101. However, in embodiments wherein the position of an arm 108 is not axially fixed on central shaft 101, a support arm slot 104 may be used to choreograph axial movement of an arm 108. For example, if the axial position of a support arm 108 is not fixed and a support arm slot 104 is oriented diagonally with respect to central shaft 101, rather than perpendicular as shown, the support arm 108 will move axially as well as circumferentially with respect to central shaft 101.

Figure 5:
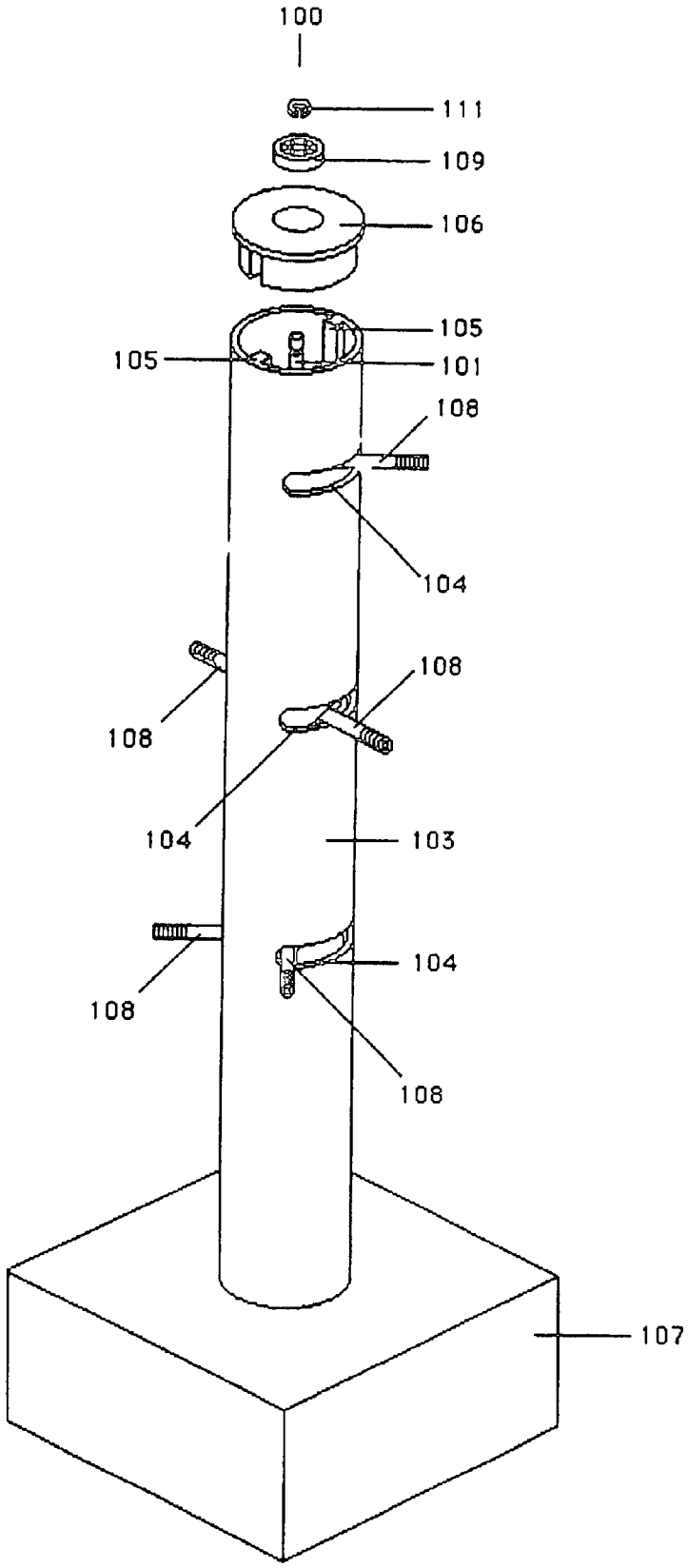
FIG. 5 is an exploded perspective view of a preferred embodiment of the invention showing details of central shaft assembly construction.

In FIG. 5 the upper components of central shaft assembly have been exploded to reveal additional details of the invention 1. Support tube 103 is ideally constructed of extruded aluminum and is provided with two longitudinal inner rails 105 which serve to guide the axial movement of the two inner cam slide members 112 (see FIG. 6), as well as prevent relative rotation between cam member 123 (composed of slide members 112) and support tube 103. End cap 106 is provided with a cup-shaped indentation which accepts and holds upper guide bearing 109 which, in turn, is affixed to central shaft 101 by a retaining clip 111. Upper guide bearing 109 provides stability to central shaft 101.

Figure 6:
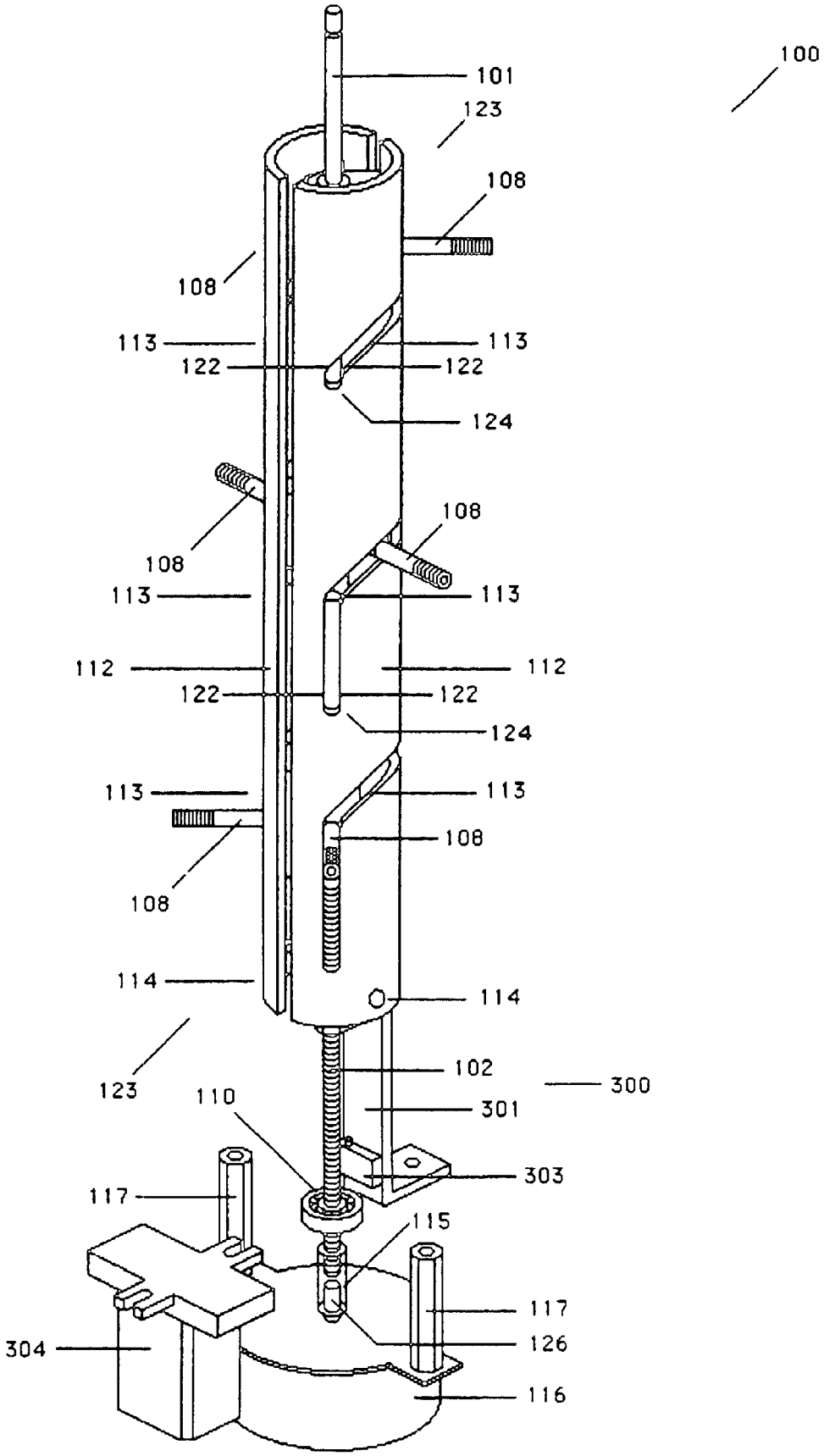
FIG. 6 is a perspective view of a preferred embodiment of the invention showing details of central shaft assembly construction with selected parts removed for clarity.

In FIG. 6 the support tube 103 and enclosure 107 have been removed to reveal additional details of central shaft assembly 100. Cam member 123 preferably comprises a pair of cam slide members 112, each of which forms a semi-tubular cross-section. Various shapes of cam members 123 may be employed, although the tubular cam member 123 shown is extremely versatile. Cam slide members 112 are provided with a number of cam surfaces 122, which are positioned so as to be engageable with at least one support arm 108. Cam slide members 112 are axially movable in relation to central shaft 101. Preferably, cam surfaces 122 are included in cam slots 113, through which support arms 108 extend. In the embodiment shown, each of the two cam slide members 112 is provided with three cam slots 113. As cam slide members 112 move axially of central shaft 101, cam surfaces 122 come into contact with support arms 108, causing them to move circumferentially about central shaft 101. Lower shaft support bearing 110, latching relay 304 and limit switch bracket 301 attach directly to the underside of enclosure 107 (not shown), while a rotative force generator, such as an electric motor 116, is attached to the underside of enclosure 107 by means of mounting posts 117.

Figure 7:
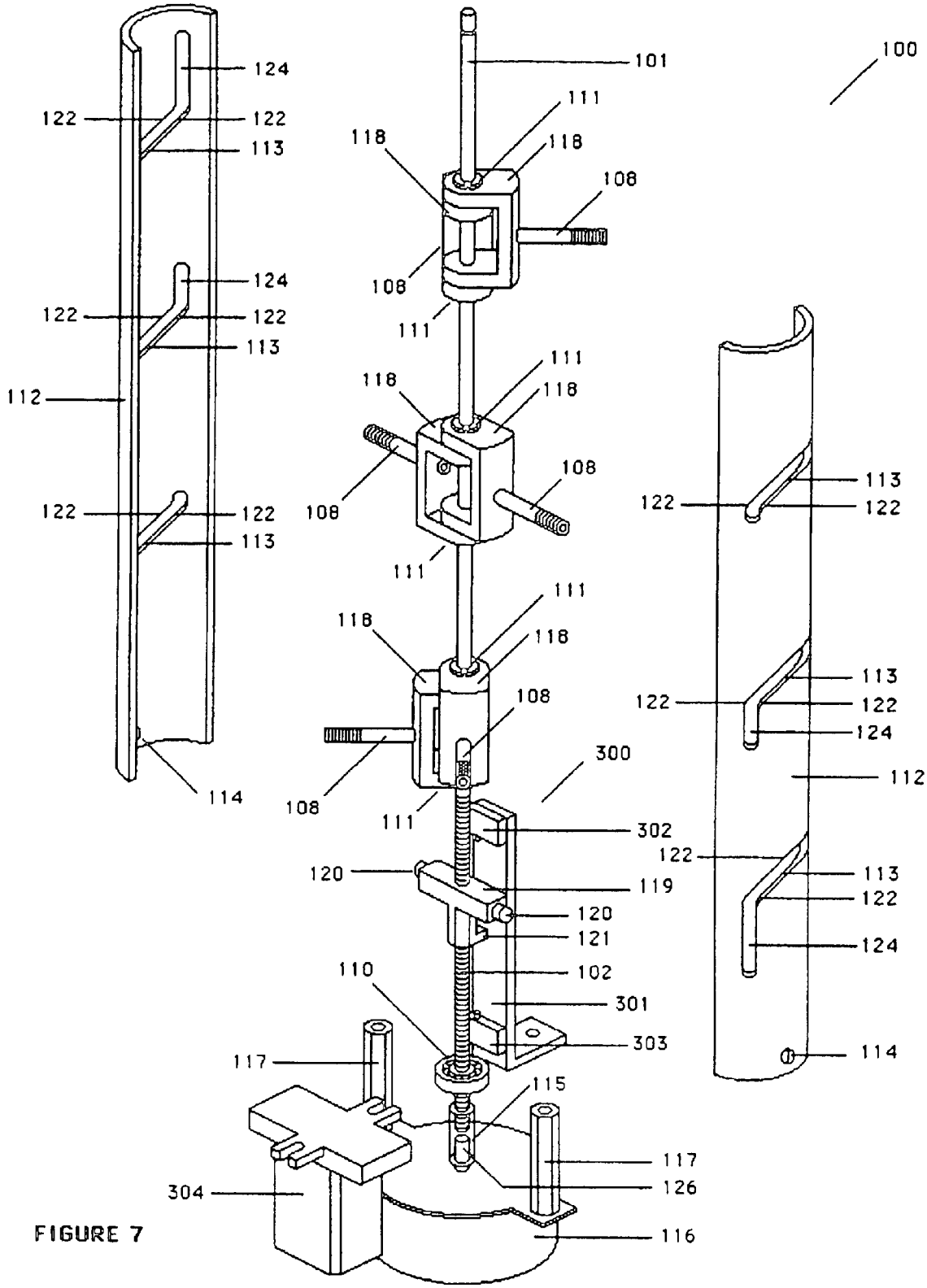
FIG. 7 is an exploded perspective view of a preferred embodiment of the invention showing the cam surfaces and inner shaft assembly components.

In FIG. 7 the two cam slide members 112 have been exploded to reveal further details of shaft assembly 100.

Support arms 108 are rotatably attached to central shaft 101 using pivot blocks 118, which allow support arms 108 to rotate around central shaft 101. In the embodiment shown, pivot blocks are preferably rotatably attached to central shaft 101 in an axially fixed position using retaining clips 111. The lower end of central shaft 101 is connected to motor shaft 126 of reversible motor 116 (such as a Hansen Model SC-234 motor) by a flexible coupling 115 and is provided with a threaded portion 102, preferably threaded with Acme threads. Threaded onto threaded portion 102 is yoke 119, which is movable axially along central shaft 101 by the action of motor 116 turning central shaft 101. This axial motion is transmitted to cam slide members 112 by coupling pins 120 on yoke 119, which engage yoke attachment holes 114. Yoke tongue 121 activates limit switches 302,303 (such as Micro Switch Model 1SX48-T switches) at either end of the yoke's limits of travel on threaded portion 102. Limit switches are positioned on limit switch bracket 301, and are electronically connected to latching relay 304 (such as a Potter & Brumfield Model KUL5A15S relay), which causes motor 116 to reverse rotation when a limit switch 302,303 is activated. In the embodiment shown, rotation of central shaft 101 is converted to axial force for moving cam member 123. However, alternate means, including external force, may be employed to form a reciprocating mechanism which will axially move cam member 123 in a path toward and away from the base of the display device.

Thus, yoke 119 and cam member 123 move back and forth axially along central shaft 101 as motor 116 operates. By changing the configuration of cam slots 113, one can change the sequences of visual element movement. In the embodiment shown, the axially-oriented portions 124 of cam slots 113 represent static periods during the choreography of movement of a particular support arm 108. Thus, as cam member 123 moves downward (toward motor 116) from the position shown in FIG. 1 to the position shown in FIG. 3, the upper level visual elements 201,202 move immediately, while middle level visual elements 203,204 move after a short delay, and lower level visual elements 205,206 move after a longer delay.

Figure 8:
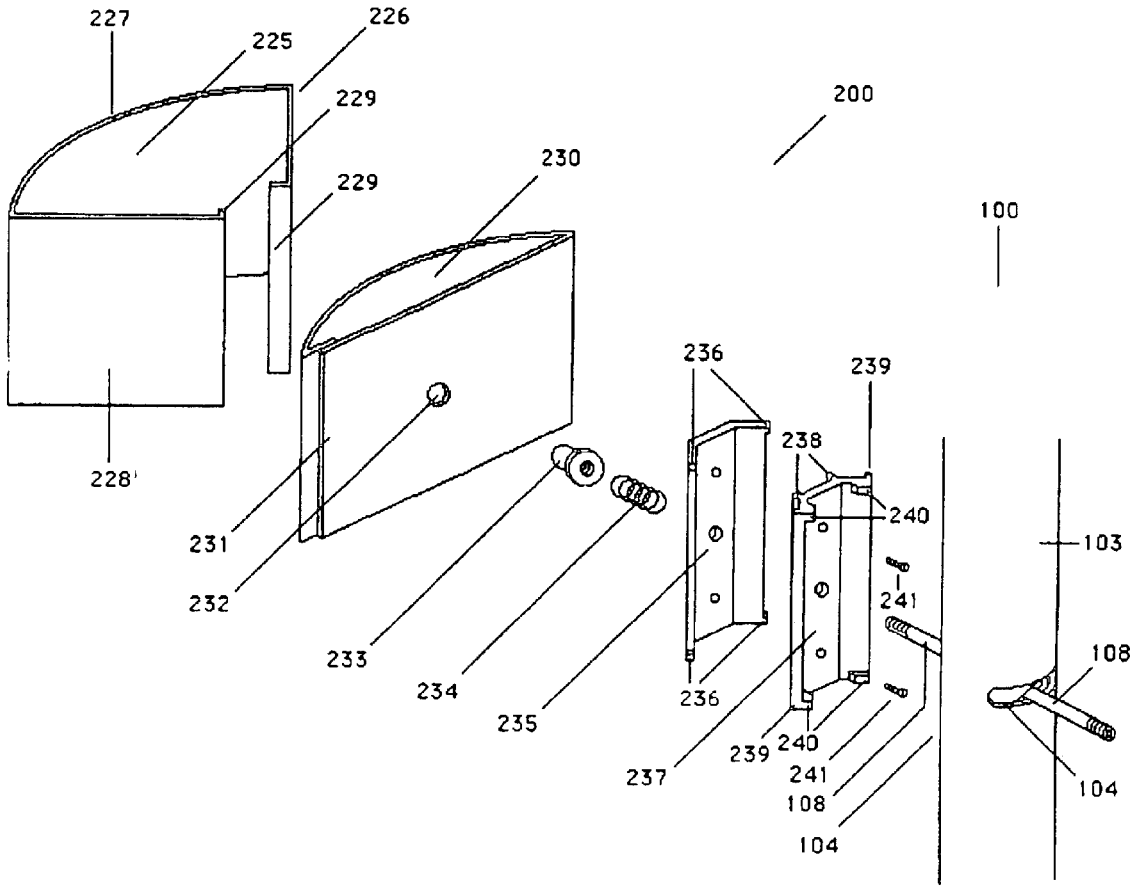
FIG. 8 is an exploded perspective view of a preferred embodiment of a visual element.

FIG. 8 is an exploded view of a preferred embodiment of a visual element 200, illustrated in relation to that section of central shaft assembly 100 to which it is attached via support arm 108. Visual element spine 237 and clamp 235 are held together by clamp screws 241, forming channels which entrap ears 229 of graphic sidewall 225. The correct width of these channels is established by spacer rails 238. Graphic alignment guides 236 and graphic retention ribs 239 help hold graphic sidewall 225 in the correct position. The shape of graphic sidewall 225 is maintained by form 230, which is held in shape by the tension in its inner chord. Form 230 is bonded together at tab 231. Both graphic sidewall 225 and form 230 are preferably constructed of printable, foldable sheet material such as styrene plastic. Support arm 108 extends through holes 242 in spine 237 and clamp 235, further penetrating spring 234, and terminating in a threaded connection to support arm end fitting 233. The compression of spring 234 forces the entire assembly into an axially aligned position on support tube 103. Slides 240 on spine 237 provide points of sliding contact with support tube 103. Slides 240, and preferably the entire spine 237, are constructed of self-lubricating plastic. Support arm end fitting 233 further engages form 230 via socket 232, by means of which engagement the circumferential motion of support arm 108 is imparted to form 230 and graphic sidewall 225. Graphic sidewall 225 displays on its outer surface graphic faces 226–228.

Figure 9:
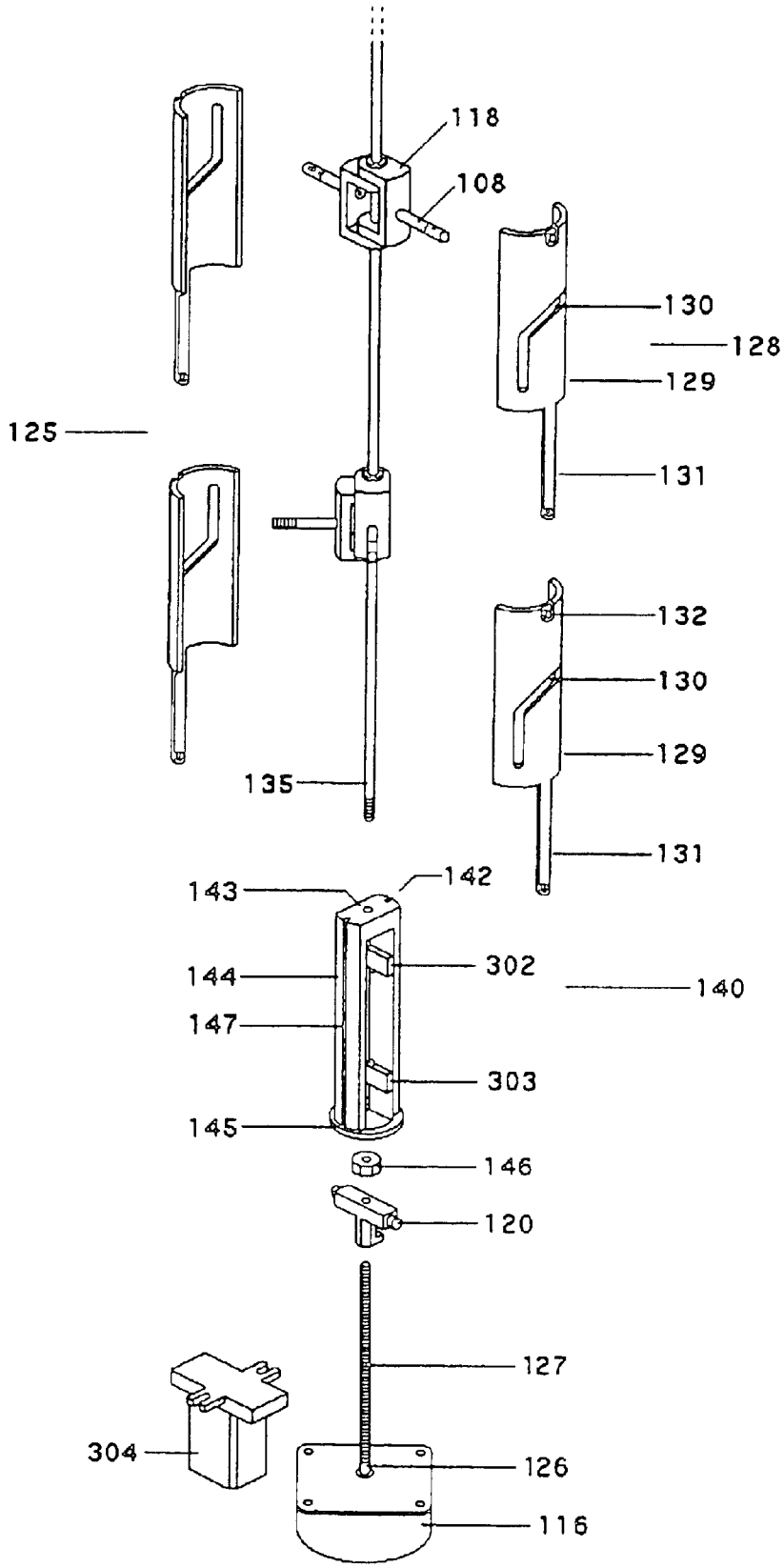
FIG. 9 is an exploded perspective view of an alternative embodiment of the operating mechanism of the display device.

An alternate manner of configuring the cam members and the yoke structure for moving the cam members is seen in FIG. 9. FIG. 9 illustrates an alternate display device 125 which is shown with support tube 103 and enclosure 107 removed since these elements are substantially similar to those seen in FIG. 5. Additionally, display device 125 will include pivot blocks 118 and support arms 108 operating in the same manner as described above. However, display device 125 differs from the previous embodiment in the manner by which the central shaft is isolated from the torque generated by the motor. FIG. 9 illustrates a central shaft 135 which is not connected to the motor shaft 126 or the motor shaft's threaded portion 127. Central shaft 135 will extend through the aperture 143 on shaft hanger 142 and will be retained by drawnut 146. Shaft hanger 142 will include two frame sidewalls 144 extending upward from base ring 145 and a guide slot 147 will be formed in each frame sidewall 144. The purpose of guide slots 147 is to engage the guide rails 105 in support tube 103 (see FIG. 5) when shaft hanger 142 is inserted into support tube 103. Shaft hanger 142 will slide into support tube 103 until base ring 145 engages the bottom of support tube 103. On the inside surface of one frame sidewall 144 will be upper limit switch 302 and lower limit switch 303. While shown outside of shaft hanger 142 in the exploded view of FIG. 9, it will be understood that yoke 119 will be positioned between frame sidewalls 144 and will travel up and down between upper and lower limit switches 302 and 303. Motor shaft threaded portion 127 will extend through base ring 145 and yoke 119. Connected to motor 116 is relay 304 which operates to reverse the direction of motor 116 when yoke 119 contacts limit switch 302 or 303 as described in the previous embodiment. It can be seen that this configuration will allow motor shaft threaded portion 127 to rotate in order to raise and lower yoke 119 (and thus cam slides 129). However, since shaft hanger 142 is fixed in place by guide slots 147, hanger shaft 142 does not rotate and central shaft 135 has no tendency to rotate. It has been found that rotation of the entire central shaft such as in the embodiment of FIG. 7 tends to induce undesirable vibration and reduces the appearance of smooth movement in the display device.

Display device 125 also differs from the previous embodiment in that cam member 128 is formed from a series of separate cam slides 129 as opposed the continuous cam slides described in previous figures. Cam slides 129 will be joined by cam link 131 attaching to the connecting lug 132 on the adjacent cam slide 129 below while the bottom most cam link 131 will attach to coupling pin 120 on yoke 119. As with previous embodiments, the cam slots 130 on each cam slide 129 will form a plurality of separate and parallel cam surfaces. The cam slots 130 on each cam slide 129 will also interact with the support arms 108 in the same manner described above.

Figures 10A, 10B:
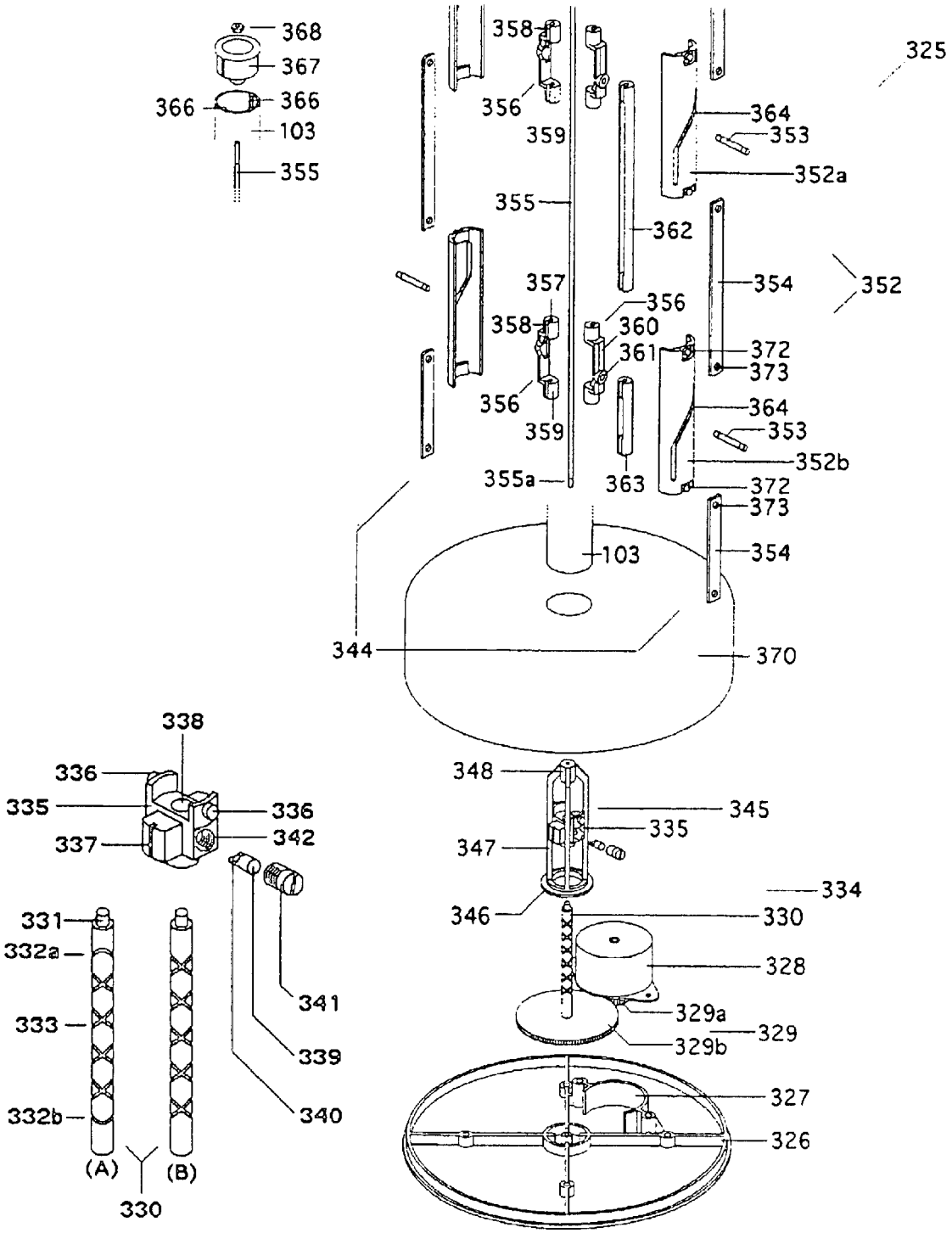
FIG. 10*a* is an exploded view of a further embodiment of the operating mechanism of the display device.
FiG. 10*b* is a detailed view of the worm shaft and yoke assembly seen in FIG. 10*a*.
Figures 11A, 11B:
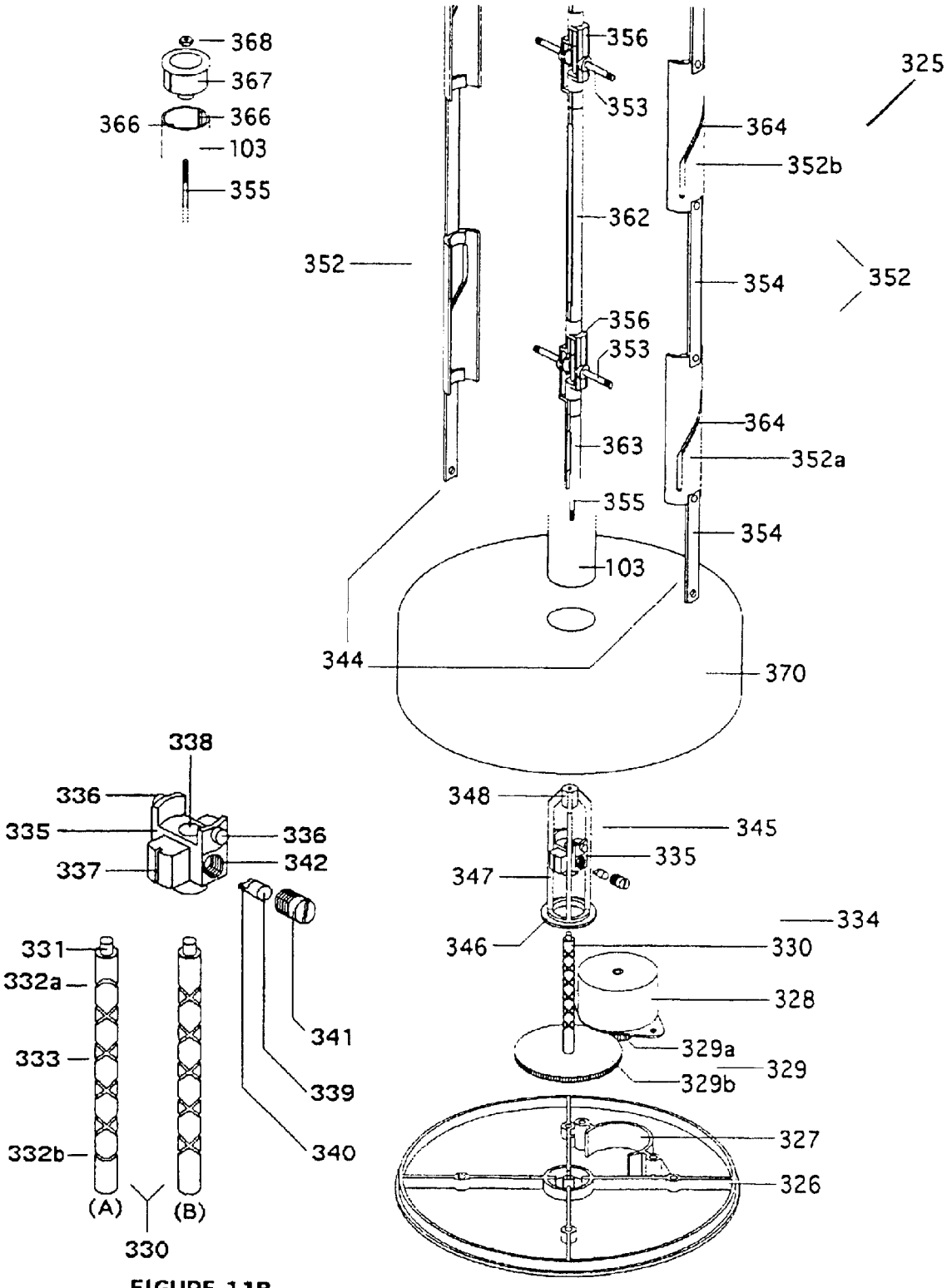
FIG. 11*a* is an exploded view of a further embodiment of the operating mechanism of the display device.
FIG. 11*b* is a detailed view of the worm shaft and yoke assembly seen in FIG. 11*a*.

A still further embodiment of the display device, display device 325, is seen in FIGS. 10 and 11. As in FIG. 9, the support tube 103 has largely been removed from the figures, but a bottom section and top section of support tube 103 can still be seen to explain the relative location of certain elements. One distinction between the embodiment of FIG. 10*a* and previous embodiments is the pivot blocks 356 which rotatively connect support arms 353 to central shaft 355. The pivot blocks 356 are comprised of two end caps 359 connected by rib section 360. End caps 359 include a shaft aperture 357 which is slightly larger than the diameter of center shaft 355 and attachment slot 358 which communicates through end caps 359 to shaft aperture 357. If end caps 359 are made of a flexible material (such as plastic) and attachment slots 358 are slightly narrower than the diameter of center shaft 355, it can be understood how attachment slots 358 may be pressed against center shaft 355 until end caps 359 "snap" into place on center shaft 355. Pivot blocks 356 should now be in a position to rotate freely on center shaft 355. Pivot blocks 356 will also include a support arm aperture 361 positioned on rib section 360. It will be readily apparent that support arms 353 will engage support arm apertures 361 in order to be rotatively positioned upon center shaft 355. Additionally, there will be short spacers 363 and long spacers 362 employed to maintain pivot blocks 356 at a proper distance from one another. The spacers will also include a shaft aperture and attachment slot and will "snap" into place on center shaft 355 in the same manner as pivot blocks 356. FIG. 11*a* illustrates pivot blocks 356 and spacers 362, 363 mounted on center shaft 355.

Again viewing FIG. 10*a*, it can also be seen that cam member 344 is formed somewhat differently than in FIG. 9 in that cam slides 352 have multiple sections 352*a* and 352*b*. The cam slides 352 in FIG. 10*a* will have a connecting lug 372 at their top and bottom ends rather than the integrally formed cam link seen in FIG. 9. The connecting lugs 372 will engage connecting apertures 373 on cam links 354 in order to form an that interconnected series of cam slide sections as seen in FIG. 11*a*. It will be readily apparent how the support arms 353 will engage the cam slots 364 in a manner similar to previous embodiments. FIG. 11*a* also shows the top end of support tube 103, internal rails 366, end plug 367, and nut 368 which engages the threaded end of central shaft 355.

Returning to FIG. 10*a*, a still further difference from previous embodiments is the reciprocating mechanism 334 which will move cam member 344 toward and away from the base of the display device. The reciprocating mechanism 334 will still include a shaft hanger and yoke, but now does not require limit switches or a reversible motor. Shaft hanger 345 will include a base ring 346, a cap 348, and a series of side rods 347 extending therebetween. Cap 348 will include a threaded aperture to receive the threaded end 355*a* of central shaft 355. The bottom of cap 348 will also have an aperture to receive the hanger pin 331 formed on worm shaft 330 (see FIG. 10*b*). A base plate 326 with a motor bracket 327 will support motor 328 and spur gear set 329, which includes a pinion gear 329*a* and a driven gear 329*b*. The worm shaft 330 is attached to and extends upwardly on driven gear 329*b*. Base plate 326 and the components connected thereto (including base cover 370) will generally form the base member of the display device in a similar manner as the motor, mounting posts, base enclosure, etc. do in previous embodiments. It will be readily apparent how motor 328 transfers torque through spur gear set 329 and thus to worm shaft 330. The yoke 335 positioned in shaft hanger 345 is best seen in FIG. 10*b*. Yoke 335 will include coupling pins 336 as with previous embodiments, but will now also include a guide slot 337 and an center aperture 338 through which the worm shaft 330 will pass. FIG. 10*b* shows a first side (A) and a second side (B) of worm shaft 330 and a continuous channel 333 formed on the first and second sides. Channel 333 is continuous in that it travels in a spiral pattern up worm shaft 330 and then reaches a transition channel 332*a* (see side (A) in FIG. 10*b*) which curves back down into a downward spiral pattern until encountering transition channel 332*b* which curves channel 330 back into an upward spiral. The purpose of channel 330 will be to engage the pawl 339 within yoke 335. In FIG. 10*b*, pawl 339 is shown withdrawn from its pawl aperture 342. It can be seen that pawl 339 has a pawl blade 340 which is the actual surface engaging channel 333 on worm shaft 330. Pawl 339 will be inserted into pawl aperture 342 and pawl cap 341 will threadedly engage aperture 342 to maintain pawl 339 in engagement with worm shaft 330. While not shown, it will be understood that pawl cap 341 has a hollow interior within which pawl 339 rests. It is also important to understand that pawl 339 is free to rotate within the interior of pawl cap 341.

It may be conceptualized how, when worm shaft 330 extends through aperture 338, pawl blade 340 on pawl 339 will engage channel 333. Therefore, when worm shaft 330 rotates, pawl blade 340 will follow channel 333 upwards or downward depending of the direction of channel 333's spiral at that point. It can be seen whichever direction pawl 339 moves, yoke 335 will also move. As pawl blade 340 travels up worm shaft 330, it will eventually encounter transition channel 332*a* and be directed in the downward direction to travel down worm shaft 330 until pawl blade 340 encounters transition channel 332*b* and returns to moving in an upward direction. Thus, it can be seen how the continuous channel 333 will cause yoke 335 to move upward and downward in a reciprocating motion as long as worm shaft 330 is rotating. Additionally, it will be understood that worm shaft 330 may always rotate in the same direction and still cause yoke 335 to move up and down the shaft. This allows for the considerable advantage of omitting the limit switches, relay circuitry and the requirement that the motor be a reversible motor. This simplifies the electronics and ultimately renders the display device less expensive to manufacture and more mechanically reliable.

Figure 12:
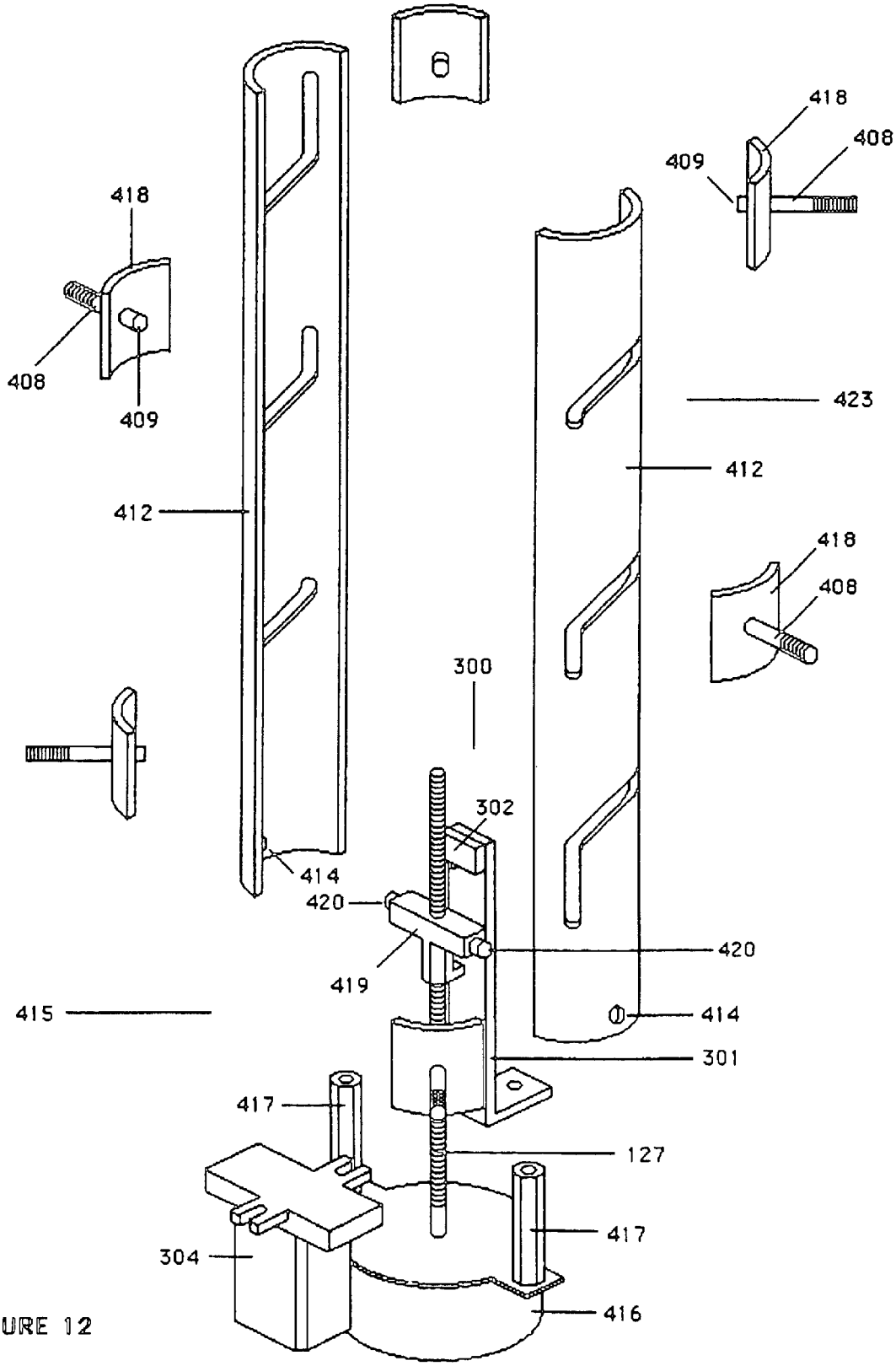
FIG. 12 is a view of an alternate embodiment of the display device which eliminates the central shaft and utilizes pivot plates for the support arms.
Figure 13:
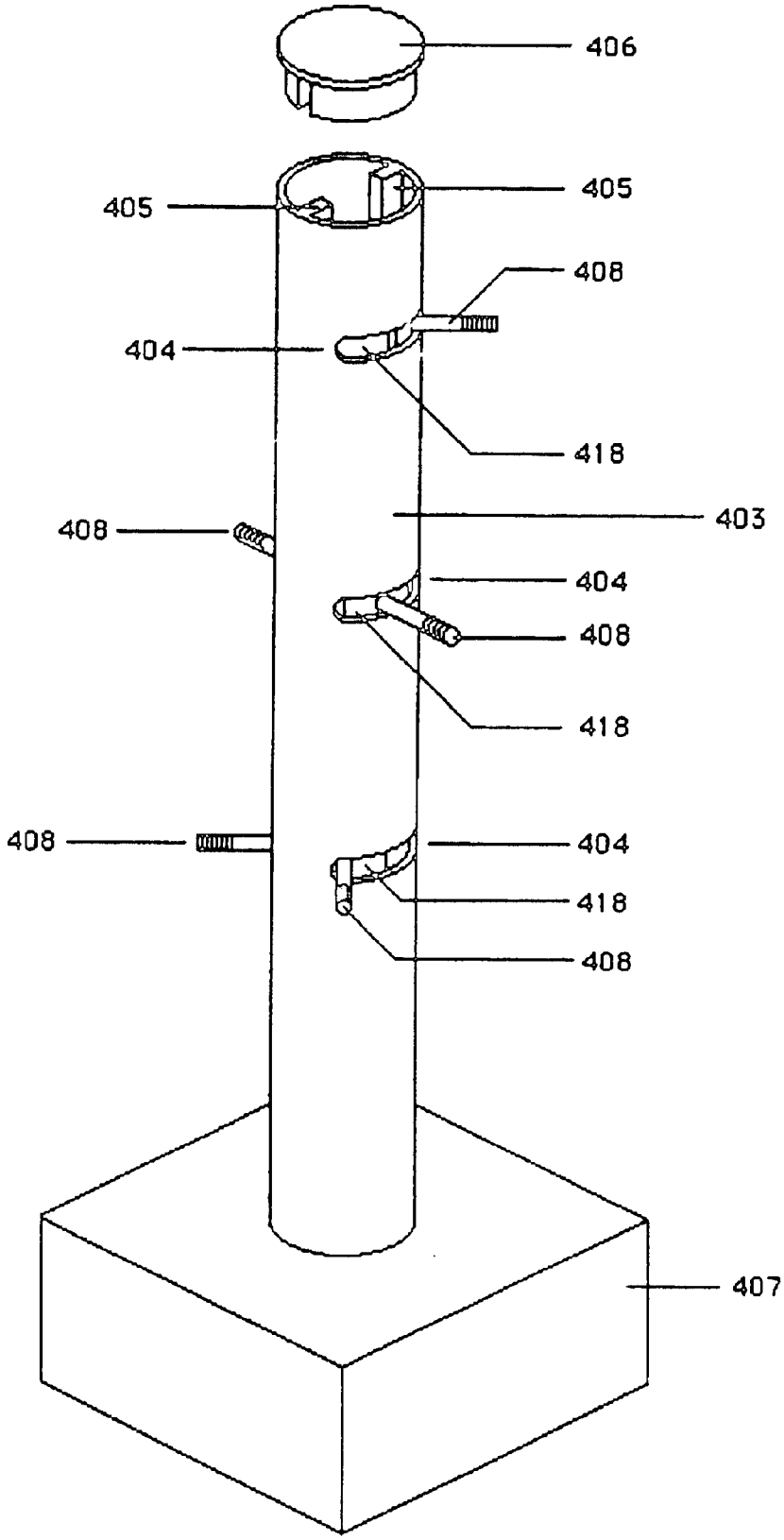
FIG. 13 is an assembled view of the embodiment seen in FIG. 12.

A still further alternate embodiment of the display device is seen in FIGS. 12 and 13. This embodiment eliminates the central shaft and pivot blocks shown in previous embodiments. Rather than employing pivot blocks to mount the support arms, this embodiment utilizes pivot plates 418 retained between the cam slides 412 and the inner surface of support tube 403. Pivot plates 418 are arcuate sections of material that have a curvature corresponding to the curvature of cam slides 412 of cam member 423. Pivot plates 418 will have a support arm 408 securely fixed thereto by any conventional means. Additionally, the rear surface of pivot plates 418 will include a cam pin 409 extending therefrom. In a preferred embodiment, pivot plates 418 are molded from a plastic material and support arms 408 and cam pins 409 are integrally formed on pivot plates 418 during the molding process. In one embodiment, pivot plates 418 may be formed of a comparatively low friction material such as teflon impregnated nylon. The use of low friction materials will be more advantageous when dealing with larger scale versions of the display device since frictional forces are more of a concern in larger devices having greater surface areas and greater forces acting between the moving parts. It can be visualized how cam pins 409 may engage cam slots 413 while arcuate pivot plates 418 are retained between the outer surface of cam slide 412 and the inner surface of support tube 403. As is best shown in FIG. 13, support tube 403 will hold pivot plates 418 against cam slides 412 while support arms 408 extend through support arm slots 404 on support tube 403. The upper and lower edges of support arm slots 404 prevent axial motion of the support arms 408. FIG. 13 also shows support tube end cap 406, base enclosure 407 and inner rails 405 similar to previous embodiments. While support arm slots 404 are shown as being horizontal in FIG. 13, the present invention also contemplates support arm slots 404 which are formed at various angles to the horizontal which would create more complex and unique motion of support arms 408 and thus, the visual elements 201–206.

Returning to FIG. 12, it may be seen that the reciprocating mechanism 415 for this embodiment is the motor shaft threaded portion 127 and yoke 419 similar to the embodiments seen in FIGS. 7 and 9. Like previous embodiments, yoke 419 will include a coupling pin 420 for engaging attachment apertures 414 on cam slides 412. Motor 416 will include mounting post 417 for connection to a base enclosure (not shown) as described in previous embodiments. In the embodiment shown, motor 416 is a reversible motor controlled by limit switches 302 and 303 (hidden from view in FIG. 7) and relay 304 Nevertheless, the pivot plate embodiment of the invention could just as readily be employed with a worm shaft having a continuous channel and being connected to a non-reversible motor as in FIG. 10. Likewise, while cam slides 412 are shown as unitary cam slides, multiple segment cam slides such as seen in FIG. 10 could also be employed.

Figure 14:
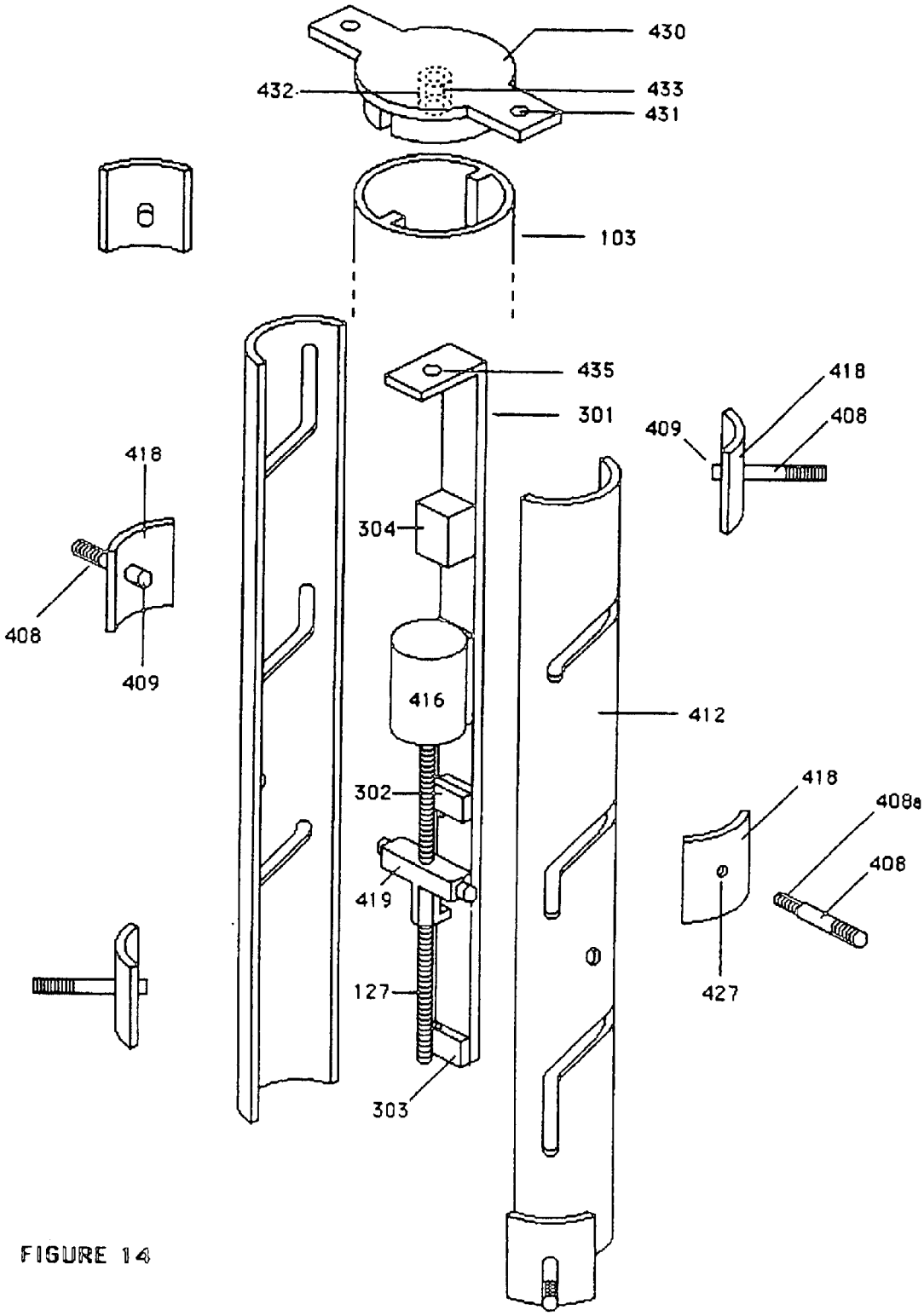
FIG. 14 illustrates an alternate embodiment which is a hanging version of the display device.

A still further embodiment is seen in FIG. 14. This embodiment differs from previous ones in that the base member is formed at the top of support shaft 103 rather than at the bottom. The base member will include a hanging end cap 430 which has securing apertures 431 to allow screws or bolts to attach hanging end cap 430 to an overhead structure (e.g. a ceiling or overhead beam). Hanging end cap 430 may be secured to support shaft 103 by any conventional manner such as adhesives or a sufficiently tight friction fit. Shown with dashed lines is an internal mounting post 432 formed on the lower interior of hanging end cap 430. Mounting post 432 will have an internal threaded aperture 433 such that a screw or bolt may pass through aperture 435 on bracket 301 and engage threaded aperture 433.

The embodiment of FIG. 14 also differs from previous embodiments in that the motor 416 is mounted internally on bracket 301 along with latching relay 304. However, yoke 419 will travel up and down shaft threaded portion 127 while latching relay 304 is triggered by limit switches 302 and 303 in the same manner as described above.

FIG. 14 also illustrates an assembly and construction detail of the display device in which pivot plate 418 and cam pin 409 are constructed as a unit and are equipped with threaded aperture 427. Further, support arm 408 has a threaded extension 408*a* which engages with threaded aperture 427. Support arm 408 can thus be disengaged from the pivot plate 418 and cam pin 409 during assembly.

The shapes and configurations of the invention 1 are limitless. In particular, FIG. 14 illustrates how the base member of the display device is not limited to any particular location or position on support tube 103. It is only necessary that the base member provide some manner of adhering the display device to a supporting surface. Other embodiments of the invention will occur to those of skill in the art, and are intended to be within the scope and spirit of the following claims.

I claim:

1. A display device, comprising:

a base member;

a cam member having at least one cam surface, said cam member being positioned so as to be movable at least axially in relation to said base member;

a pivot plate positioned adjacent said cam member, said pivot plate having a support arm extending in a first direction and a cam pin extending in a second direction to engage said cam surface; and a support tube with a support arm slot positioned over said cam member and said support arm extending through said support arm slot.

2. The display device according to claim 1, wherein said cam surface includes a cam slot and said cam pin engages said cam slot.

3. The display device according to claim 1, wherein said cam member has an arcuate shape and said pivot plate has a corresponding arcuate shape.

4. The display device according to claim 1, wherein a said support arm slots are oriented generally perpendicular to a length of said support tube.

5. The display device according to claim 4, wherein said support tube includes an internal rail to fix said cam member against rotation.

6. The display device according to claim 1, further including a rotating shaft extending from said base member and a yoke positioned on said rotating shaft with said yoke being connected to said cam member.

7. The display device according to claim 6, wherein said yoke is attached to said cam member and fixed against rotation.

8. The display device according to claim 6, wherein a torque source supplies torque to said rotating shaft.

9. The display device according to claim 8, wherein said torque source is a motor positioned on said base member.

10. The display device according to claim 8, wherein said rotating shaft has a continuous groove along its length which is engaged by said yoke.

11. A display device, comprising:

a base member;

a cam member having a plurality of separate and parallel cam surfaces, said cam member being positioned so as to be movable at least axially in relation to said base member; and a support arm positioned to engage each of said cam surfaces, said support arms extending in a first direction away from said cam surface and a second portion extending in a second direction to engage said cam surfaces.

12. The display device according to claim 11, wherein said support arms are fixed to a pivot plate positioned adjacent said cam member and said second portion of said support arms are cam pins extending to engage said cam surfaces.

13. The display device according to claim 11, wherein a central shaft is positioned within said cam member and said support arms extend through said cam member to pivotally engage said central shaft.

14. The display device according to claim 11, wherein a reciprocating mechanism moves said cam member in an axial direction toward and away from said base member.

15. The display device according to claim 14, wherein said reciprocating mechanism is a yoke traveling on a worm shaft.

16. The display device according to claim 15, wherein a motor is connected to said worm shaft and rotates said worm shaft to move said yoke along said worm shaft.

17. The display device according to claim 16, wherein said worm shaft is threaded and said motor is capable of rotating said worm shaft in both a clockwise and counter-clockwise direction.

18. The display device according to claim 16, wherein said worm shaft has a continuous recirculating path formed therealong and said motor rotates said worm shaft in only one direction.

19. The display device according to claim 11, wherein a support tube with support arm slots is positioned over said cam member and said support arms extend through said support arm slots.

20. The display device according to claim 19, wherein said base member is formed at a top portion of said support tube and has securing apertures for allowing said device to be positioned in a hanging configuration.

21. The display device according to claim 11, wherein a motor and is positioned within said cam member.

22. The display device according to claim 11, wherein a central shaft extends from said base member and said support arms are rotatably attached to said central shaft.

23. A display device according to claim 22, wherein a yoke is operatively connected to said cam surfaces in order to move said cam members in an axial direction relative to said central shaft.

24. A display device according to claim 23, wherein said yoke threadedly engages a worm shaft in order to move in an axial direction along said worm shaft.

25. A display device according to claim 23, wherein said yoke moves up and down in a continuous path along a worm shaft.

26. A display device according to claim 25, wherein said worm shaft rotates in the same direction as said yoke moves up and down along said worm shaft.

27. A display device according to claim 26, wherein said yoke has a pawl engaging grooves on said worm shaft.

28. A display device according to claim 27, wherein said grooves on said worm shaft transition from an upward direction to a downward direction.

29. A display device according to claim 22, wherein said cam members are separately formed and connected by elongated links.

30. A display device according to claim 22, wherein pivot blocks are attached to said support arms and rotatively engage said central shaft.

* * * * *